US006308857B1

(12) United States Patent
Heimbach et al.

(10) Patent No.: US 6,308,857 B1
(45) Date of Patent: Oct. 30, 2001

(54) VACUUM CHAMBER

(75) Inventors: Markus Heimbach, Düsseldorf; Dietmar Gentsch, Ratingen, both of (DE)

(73) Assignee: ABB Patent GmbH, Mannheim (DE)

( * ) Notice: Subject to any disclaimer, the term of this patent is extended or adjusted under 35 U.S.C. 154(b) by 0 days.

(21) Appl. No.: 09/592,298

(22) Filed: Jun. 12, 2000

(30) Foreign Application Priority Data

Jun. 10, 1999 (DE) ..... 199 26 369
Feb. 21, 2000 (DE) ..... 100 07 907

(51) Int. Cl.[7] ..... F17C 1/00
(52) U.S. Cl. ..... 220/592; 220/612; 220/654; 220/723
(58) Field of Search ..... 220/581, 582, 220/592, 612, 614, 651, 654, 723

(56) References Cited

U.S. PATENT DOCUMENTS 884,450 * 4/1908 Wright ..... 220/654
1,483,293 * 2/1924 Foster et al. ..... 220/654
2,164,660 * 7/1939 Miller ..... 220/654
3,616,958 * 11/1971 Mitchell ..... 220/581
4,846,363 * 7/1989 Gough ..... 220/581
5,413,230 * 5/1995 Folter et al. ..... 220/581
5,427,268 * 6/1995 Downing, Jr. et al. ..... 220/581
6,119,890 * 9/2000 Kawamata ..... 220/654

* cited by examiner

*Primary Examiner*—Joseph M. Moy
(74) *Attorney, Agent, or Firm*—Herbert L. Lerner; Laurence A. Greenberg; Werner H. Stemer

(57) ABSTRACT

A vacuum chamber having at least one insulating cylinder whose end faces are closed with the aid of one cover each is described. The vacuum chamber has a movable contact stem and a movable contact piece that is attached thereto and opposite which there is a correspondingly constructed a fixed contact piece. Fastened in a vacuum-tight fashion between the one cover and the movable contact stem is a sealing element which permits movement of the contact stem and is constructed as a bellows. The cover is of cup-shaped construction in this case, and is fastened with its free edge end, which has a section of reduced wall thickness, on the end face of the insulating body, a support ring being provided which produces a mechanical reinforcement in the region of the connection of the free edge of the cover to the insulating body. Moreover, the bellows is also of multi-layered construction, if appropriate. The vacuum chamber is capable of withstanding pressures of up to 25 bars given suitable dimensioning of the support ring and of the cover as well as of the bellows.

21 Claims, 4 Drawing Sheets

VACUUM CHAMBER

BACKGROUND OF THE INVENTION

1. Field of the Invention

The invention relates to a vacuum chamber that has at least one insulating cylinder made from a ceramic material and has end faces that are each covered by a cover. A movable contact piece that is attached to a movable stem is also provided in the vacuum chamber. A vacuum-tight sealing element is fastened between one cover and the movable contact stem to permit the movement of the contact stem.

Such vacuum chambers are customarily used in a switchgear assembly whose gas, such as air, is an insulating gas that is normally at atmospheric pressure. Consequently, the insulating cylinder, the covers and the bellows are configured in terms of strength for atmospheric pressure.

Cases are conceivable in which the vacuum chamber is installed in a switchgear assembly whose pressure is substantially increased, for example up to approximately 25 bars, with the result that the insulating cylinder, the covers and the fastening points of the covers on the insulating cylinder, and the bellows must all be configured such that they withstand this pressure.

2. Summary of the Invention

It is accordingly an object of the invention to provide a vacuum chamber that overcomes the above-mentioned disadvantages of the prior art devices of this general type, which is configured to operate at a high pressure of approximately 25 bars.

With the foregoing and other objects in view there is provided, in accordance with the invention, a vacuum chamber, including:

- a plurality of covers each constructed in a cup-shaped fashion and having a main region with a first thickness and a free end with a second thickness being thinner than the first thickness and extending from the main region;
- at least one insulating cylinder made from ceramic and having end faces each closed by one of the covers;
- at least one support ring disposed between each of the covers and an end face of the end faces of the insulating cylinder, the free end of each of the covers firmly soldered to the end
- faces of the insulating cylinder with an interposition of the support ring there-between;
- a movable contact stem;
- a movable contact piece attached to the movable contact stem;
- a fixed contact stem;
- a fixed contact piece attached to the fixed contact stem, the movable contact piece attached to the movable contact stem and the fixed contact piece attached to the fixed contact, respectively, penetrating the covers; and
- a vacuum-tight sealing element fastened between one of the covers and the movable contact stem and permits a movement of the moveable contact stem, the sealing element having at least one layer connected to the one of the covers and the movable contact stem.

A few specific points are important in the configuration of the vacuum chamber.

First, the cover is to be of a pressure tight configuration and, moreover, stress-compensating configurations of the cover/ceramic connection are to be provided. Only the dimensioning is to be taken into account in configuring the cover. Moreover, because of the increased pressure particular importance also attaches to the sealing element between the cover and the movable contact stem.

It is expedient for the sealing element to be at least a single-layer bellows. In the case of a multi-layer bellows, it is to be ensured that no gas can penetrate from the switchgear assembly into the interspace between the individual layers of the bellows, and this is achieved by welding the joints between layers of the bellows in a gas-tight or vacuum-tight fashion.

The sealing element can, moreover, also contain a plurality of mutually assigned frustoconical rings which resemble disk springs and are connected, in particular welded, to one another in a vacuum-tight or gas-tight fashion at the ends touching one another. The rings can be constructed in this case in one or more layers.

It is also possible to construct the sealing element as a diaphragm cover which has at least one diaphragm layer whose inner and outer edges, in the case of multi-layer configuration, are welded to one another in a vacuum-tight or gas-tight fashion and to the cover and the movable contact stem.

Furthermore, it is also to be ensured that the length of the section of the edge which has the thinner wall thickness is dimensioned such that it absorbs axial (bending or buckling) forces and radial forces.

In accordance with an added feature of the invention, the free end of each of the covers has an inner surface and the support ring has a section which runs at a slight spacing parallel to the inner surface of the free end such that a cylindrical gap is formed there-between. Solder can now be disposed in and fill the cylindrical gap.

In a particular configuration of the invention, the support ring can have an L-shaped cross section whose radial web runs between the edge and the end face of the insulating cylinder and whose axial web runs parallel to and next to the edge, solder being filled into the gap between the axial web and the inner surface of the edge.

At the same time, it is also possible to attach to the support ring a screen that screens the sealing element. It is desirable that the support ring and the screen be formed as a one-piece or integrated unit.

In a particularly advantageous configuration of the invention, the cover can consist of steel; however, it is also possible to provide a cover section which is formed partially from ceramic to which a cup-shaped cover part made from steel is connected. In this case the cover section can be fastened on the insulating cylinder separately therefrom, or it can also be integrally formed on the insulating cylinder.

The shapes of the insulating cylinder are to be constructed and dimensioned such that they are of adequate strength. For this purpose, it is possible in a known way for the ceramic cylinder to have an inwardly drawn arc at each of its two ends; it is also possible to construct the ceramic body in a somewhat bulging fashion overall, and to provide further plates known per se.

In accordance with an additional feature of the invention, the support ring is disposed and constructed from solder, shaped like a fillet, between at least one of an inner surface and an outer surface of the free end of each of the covers and the end face of the insulating cylinder. The solder covers a region of one of the outer surface and the inner surface of the free end which is adequate for absorbing compressive forces.

In accordance with another feature of the invention, the free end of the covers is soldered directly onto the end face of the insulating cylinder.

In accordance with a further added feature of the invention, the support ring is a radially running annular plate formed of copper, and the free end of the covers is fastened with an interposition of the radially running annular plate.

In accordance with a further additional feature of the invention, the annular plate projects into an interior of the vacuum chamber and serves to hold further components including a screen.

In accordance with yet another feature of the invention, the covers are formed of steel and the support ring is formed of copper.

In accordance with a concomitant feature of the invention, the covers each have a cover section formed partially from ceramic and a cup-shaped cover part made from steel connected to the cover section. The cover section has a first part formed in one of a frustoconical and an arcuate shape with a first diameter and an edge, and a second part being a radial section with a second diameter smaller than the first diameter and extending from the edge of the first part. The cup-shaped cover part is fastened to the radial section. The cover section is preferably integrally formed on the insulating cylinder.

Other features which are considered as characteristic for the invention are set forth in the appended claims.

Although the invention is illustrated and described herein as embodied in a vacuum chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
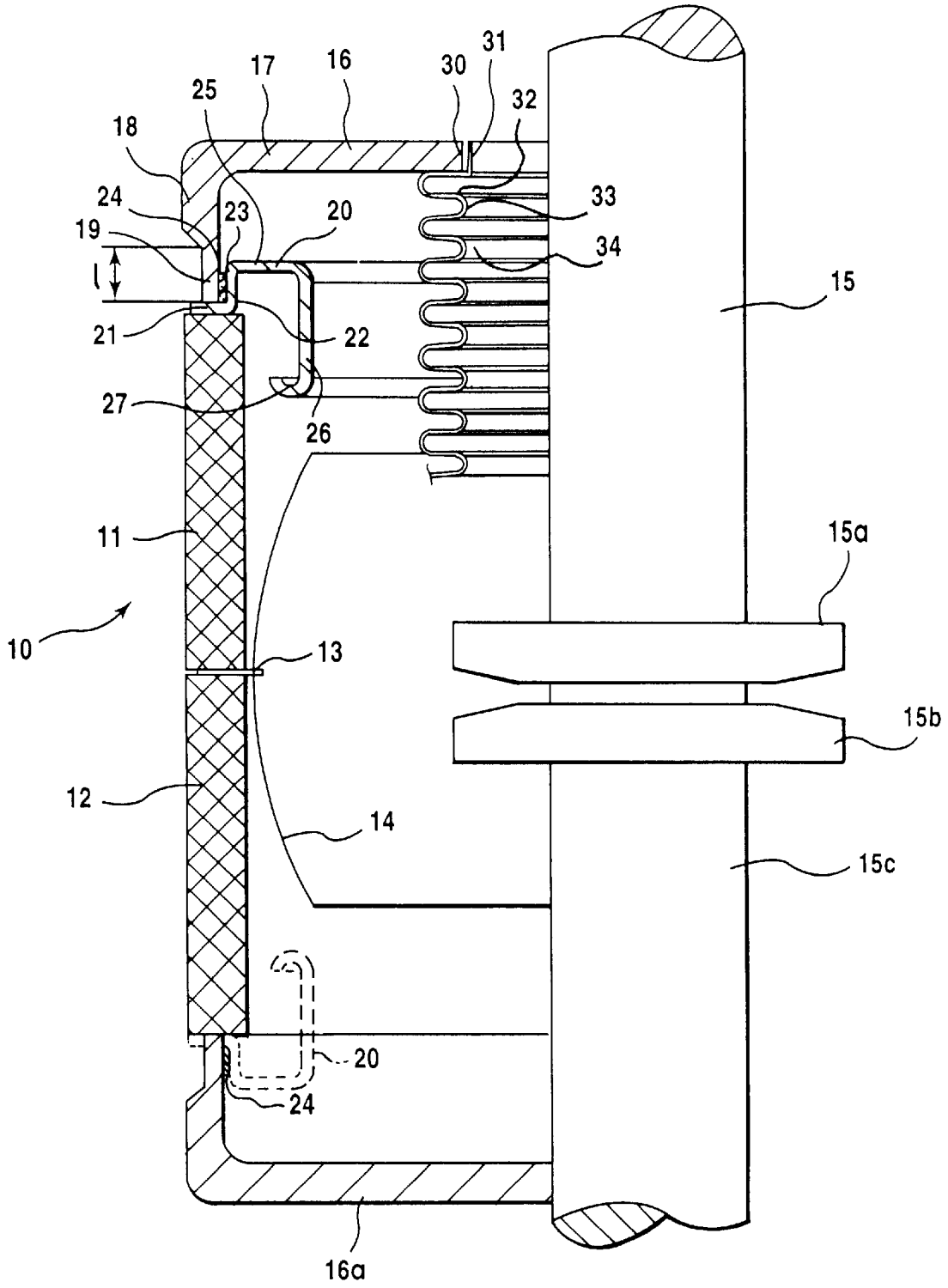
FIG. 1 is a diagrammatic, fragmented, sectional view through a vacuum chamber exposed to increased pressure and according to the invention.

In all the figures of the drawing, sub-features and integral parts that correspond to one another bear the same reference symbol in each case. Referring now to the figures of the drawing in detail and first, particularly, to FIG. 1 thereof, there is shown a vacuum chamber, which is illustrated only partially in cross section in FIG. 1. The vacuum chamber has an insulating cylinder 10 which is assembled from two ceramic cylinders 11 and 12 which hold between them a carrier 13 to which there is attached a screen 14 located in an interior of the vacuum chamber. The invention is not, however, limited to such configurations.

The vacuum chamber also has a movable contact stem 15, on which a movable contact piece 15*a* is fastened. Covers, of which only a covers 16 16*a* for closing the ceramic cylinders 11 12 are and shown, adjoin free ends of the ceramic cylinders 11 and 12. The cover 16 is of cup-shaped construction and has a cover base 17 adjoined by a cylindrical wall section 18 on whose free end there is disposed a section 19 with a wall thickness which is reduced by comparison with the remainder of the cover 16. A length of the section 19 of smaller wall thickness is 1. The reason for this reduction in the wall thickness is that the cover 16 consists, in accordance with the configuration illustrated in the drawing, of an iron-nickel alloy which above a specific temperature has a coefficient of thermal expansion which differs considerably from that of the ceramic. On the one hand, the wall thickness must be dimensioned such that an axial force does not lead to bending or buckling of the section 19, but on the other hand it must be ensured that adequate elasticity is achieved between the cover 16 and the insulating ceramic cylinder 11 so that the ceramic is prevented from breaking owing to the different thermal expansions of ceramic and the cover material during a soldering operation, which is carried out above that temperature. The cover 16*a* at the end of the ceramic cylinder 12 is similar in configuration to the cover 16. A stationary contact stem 15*c* penetrates the cover 16*a* and is rigidly connected to it. The contact stem 15*c* carries a stationary contact piece 15*b* at its inner end.

It is expedient to assign the section 19 a support ring 20 which has a radial section or web 21 which is disposed between the section 19 and the end face of the ceramic cylinder 11. Adjoining the web 21 is a web 22 running axially toward the cover base 17, there being formed between an inner surface of the wall section 18 and the web 22 a circumferential gap 23 which is filled with solder 24 during the soldering operation. The solder 24, after cooling, produces a support between the wall section 18, also called edge 18, and the web 22. An axial length of the web 22 is less than the axial length of the section 19 of reduced wall thickness. As a result of which an optimum supporting action is achieved and a favorable ability to bend outward is achieved, in order to prevent deformation of the cover 16 by excessively high external loading, and to prevent fracture of the ceramic during cooling. Optionally, a second support ring 20 is shown in dashed lines and is disposed between the cover 16*a* and the cylinder 12.

Adjoining the web 22 at one end is an inwardly directed radial section 25 and a radial section 26 which points away from the cover base 17, a screening element being formed as a result. An end of the radial section 26 is bent outward in an L-shaped or U-shaped fashion, and thereby controls an electric field.

The cover 16 has a cutout 30 to which one end 31 of a bellows 34 assembled from two layers 32 and 33 is connected. On the one hand, the bellows 34 is connected in a vacuum-tight fashion to the cover 16, and on the other hand the two layers 32, 33 are welded to one another in a vacuum-tight fashion at their ends, so as to prevent gas located inside the switchgear assembly housing from being able to penetrate between the layers. The inner end of the bellows 34 is connected in a vacuum-tight fashion to the contact stem 15 in a way not illustrated in more detail.

Figure 2:
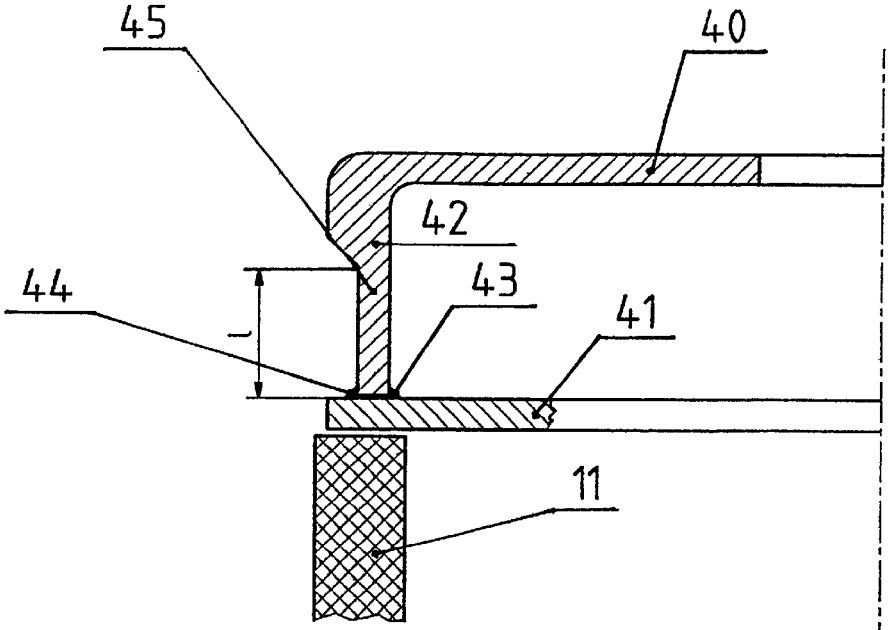
FIGS. 2 and 3 are sectional views showing different configurations of a connection between a cover and a ceramic cylinder.

FIG. 2 shows another configuration of a cover 40. Soldered on the ceramic cylinder 11 is a support plate 41 that runs radially. The cover 40 has an edge section 42 with a free end that is soldered 43, 44 on against the support plate 41. The solder 43, 44 forms solder fillets that contribute to an enforcement in a region of the connection to the support plate 41. The cover 40 has a section 45 of reduced wall thickness, which corresponds to the section 19 of the cover 16. An axial length of the section 45 is also denoted here by 1. Built-in components can be fastened inside the vacuum chamber on the disk 41 or plate 41.

The configuration in accordance with FIG. 1 and FIG. 2 is preferably configured for a pressure that is increased in comparison with atmospheric pressure.

Figure 3:
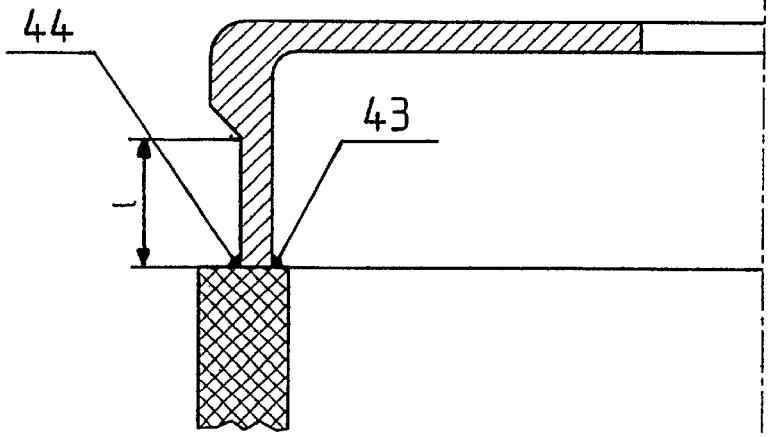

In the same way, an increased pressure loading is possible in the case of the configuration according to FIG. 3, as well. The vacuum chamber here has a configuration similar to the configuration according to FIG. 2. However, the solder 43, 44 is drawn up in the shape of a fillet, in order to illustrate that in the configuration according to FIG. 3 the same effect is achieved as in the configuration according to FIG. 2. The plate 41 is missing from the configuration according to FIG. 3.

Figure 4:
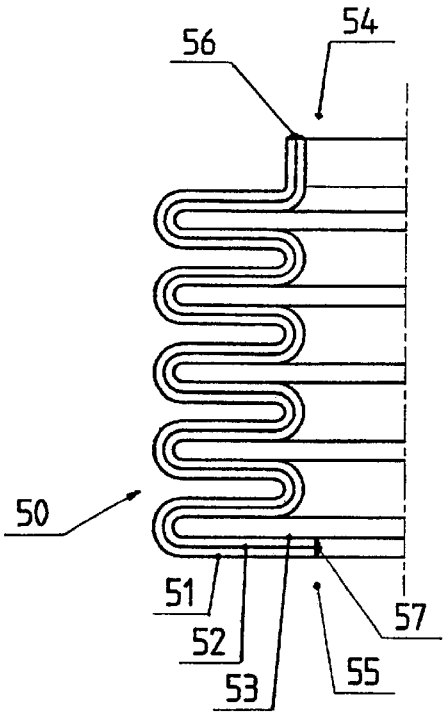
FIGS. 4 to 6 are side-elevational views of different configurations of sealing elements.
Figure 5:
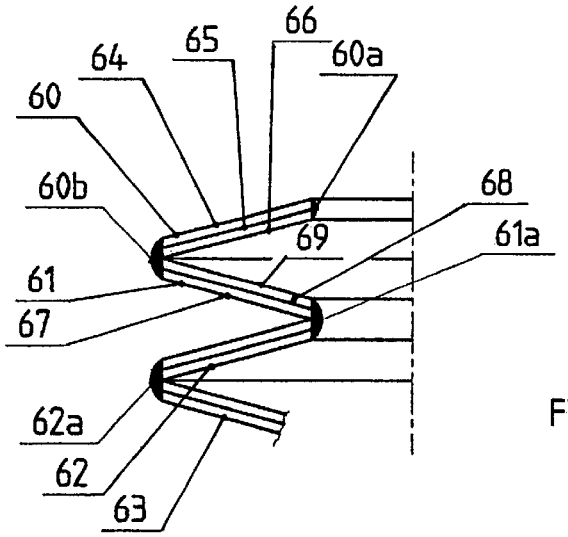
Figure 6:
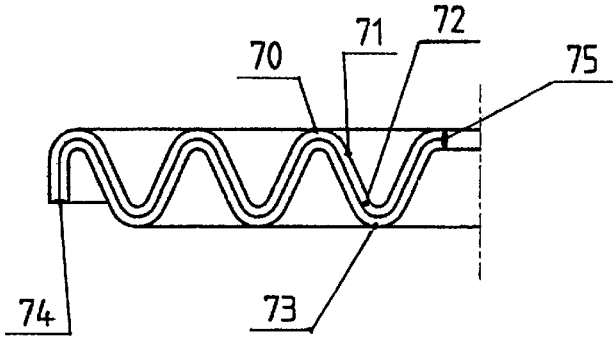

FIGS. 4 to 6 show different configurations of the sealing element between the cover and the movable contact stem 15. FIG. 4 shows a bellows configuration 50 which is assembled from three bellows layers 51, 52 and 53 which are closed in a vacuum-tight fashion by a weld 56 and 57 at an end 54 with which they are fastened on the cover, just like at an end 55 with which they are joined to the movable contact stem 15. The result being to prevent gas from passing into the interior between the layers 51 to 53. It is, of course, also possible to solder the ends 54 and 55 and then to solder the bellows configuration 50 in one method step to the cover 16, 40 and to the movable contact stem 15.

The bellows in accordance with FIG. 5 is a type of bellows which is assembled from a plurality of annular parts 60, 61, 62 and 63 which are assigned to one another in a manner of a set of disk springs. The individual sections 60 to 63 being frustoconical and being alternatingly interconnected in a vacuum-tight fashion in each case with outer edges and inner edges at 60*a*, 60*b*, 61*a*, 62*a*. In the configuration according to FIG. 5, the annular parts 60 to 63 are in three layers and each have a layer 64, 65 and 66 or 67, 68 and 69, respectively.

The configuration in accordance with FIG. 6 shows a diaphragm-like sealing element 70 which is of a radially corrugated construction and alignment, and is also assembled here from three layers 71, 72 and 73. The layers 71–73 are interconnected in a vacuum-tight fashion on their outer edge at 74 and on an inner edge at 75.

Three layers are illustrated respectively in FIGS. 4 to 6. Of course, it is also possible with all configurations to use only two layers or one or more than three layers.

Figure 7:
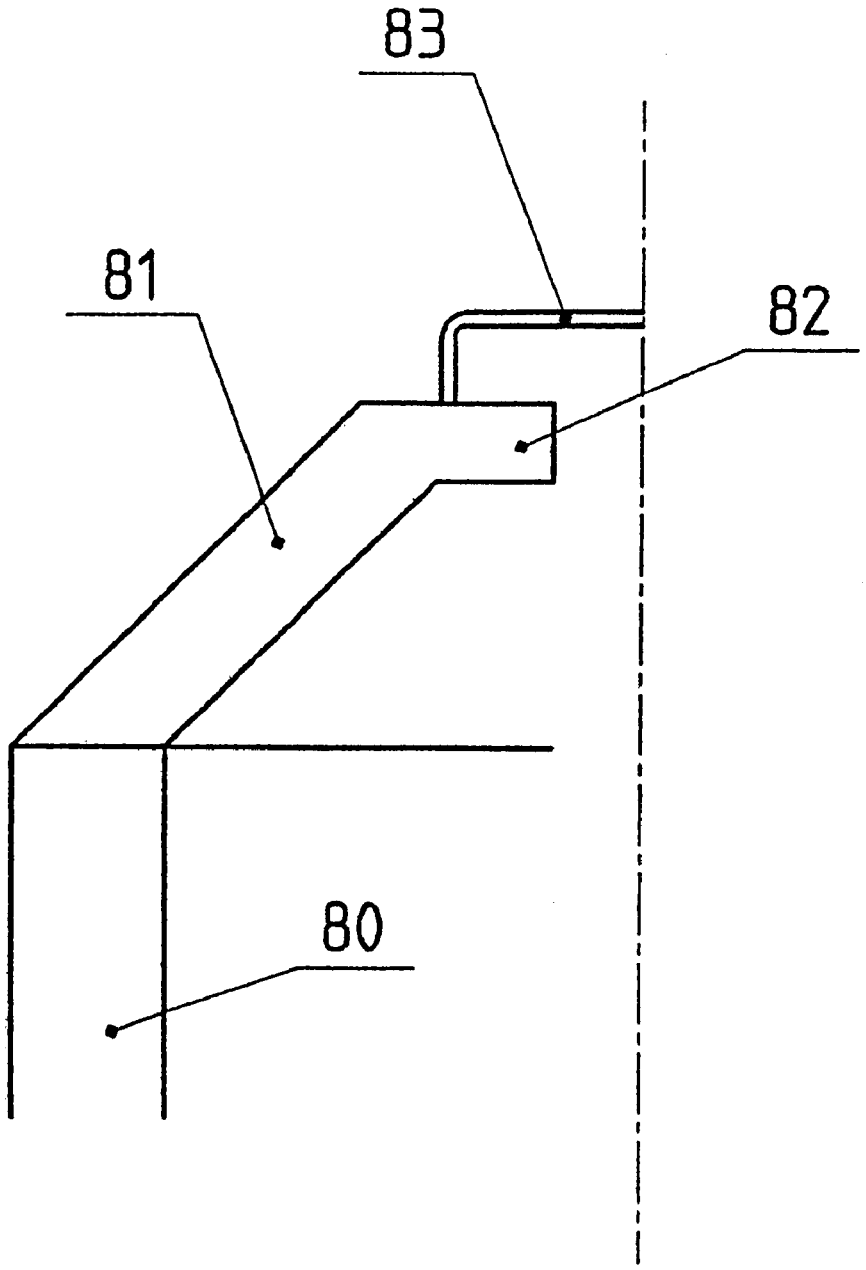
FIG. 7 is a sectional view of a further embodiment of the cover.

The vacuum chamber in accordance with FIG. 7 has, inter alia, an insulating cylinder 80 made from ceramic, to whose free end there is connected a frustoconical cover section 81 on whose inner end the cover section 81 has a radially running section 82 to which there is connected on an outside a cup-shaped cover 83. The cover section 81 can be constructed in this case in one piece with the insulating cylinder 80.

We claim:

1. A vacuum chamber, comprising:

a plurality of covers each constructed in a cup-shaped fashion and having a main region with a first thickness and a free end with a second thickness being thinner than said first thickness and extending from said main region;

at least one insulating cylinder made from ceramic and having end faces each closed by one of said covers;

at least one support ring disposed between each of said covers and an end face of said end faces of said insulating cylinder, said free end of each of said covers firmly soldered to said end faces of said insulating cylinder with an interposition of said support ring there-between;

a movable contact stem;

a movable contact piece attached to said movable contact stem;

a fixed contact stem;

a fixed contact piece attached to said fixed contact stem, said movable contact piece attached to said movable contact stem and said fixed contact piece attached to said fixed contact, respectively, penetrating said covers; and a vacuum-tight sealing element fastened between one of said covers and said movable contact stem and permits a movement of said moveable contact stem, said sealing element having at least one layer connected to said one of said covers and said movable contact stem.

2. The vacuum chamber according to claim 1, wherein said at least one layer of said sealing element is one of two layers that are welded in a vacuum-tight fashion to one another and to said one of said covers and said movable contact stem.

3. The vacuum chamber according to claim 1, wherein said sealing element is a bellows.

4. The vacuum chamber according to claim 2, wherein said bellows is formed of at least two layers.

5. The vacuum chamber according to claim 1, wherein said sealing element is a diaphragm formed of at least two layers.

6. The vacuum chamber according to claim 1, wherein said sealing element has two frustoconical diaphragms, including a first frustoconical diaphragm and a second frustoconical diaphragm, assigned to one another in a manner of disk springs and are welded to one another in a vacuum-tight fashion at points at which said two frustoconical diaphragms touch one another, said first frustoconical diaphragm is formed of two-layers and said second frustoconical diaphragm is formed of multi-layers.

7. The vacuum chamber according to claim 1, wherein said free end of each of said covers has an inner surface and said support ring has a section which runs at a slight spacing parallel to said inner surface of said free end such that a cylindrical gap is formed there-between.

8. The vacuum chamber according to claim 7, including solder disposed in and filling said cylindrical gap.

9. The vacuum chamber according to claim 8, wherein said free end has a length dimensioned such that said free end absorbs axial bending forces, axial buckling forces and radial forces, but has an adequate elasticity for balancing different thermal expansions of said covers and said insulating cylinder.

10. The vacuum chamber according to claim 9, wherein said support ring has an L-shaped cross section with a radial web running between said free end of a cover of said covers and said end face of said insulating cylinder and an axial web running parallel to and next to said inner surface of said free end.

11. The vacuum chamber according to claim 10, including a screen running parallel to said sealing element and attached to said support ring.

12. The vacuum chamber according to claim 11, wherein said support ring and said screen are a one-piece unit.

13. The vacuum chamber according to claim 1, wherein said support ring is disposed and constructed from solder, shaped like a fillet, between at least one of an inner surface and an outer surface of said free end of each of said covers and said end face of said insulating cylinder, said solder covering a region of one of said outer surface and said inner surface of said free end which is adequate for absorbing compressive forces.

14. The vacuum chamber according to claim 13, wherein said free end of said covers is soldered directly onto said end face of said insulating cylinder.

15. The vacuum chamber according to claim 1, wherein said support ring is a radially running annular plate formed of copper, and said free end of said covers is fastened with an interposition of said radially running annular plate.

16. The vacuum chamber according to claim 15, wherein said annular plate projects into an interior of the vacuum chamber and serves to hold further components including a screen.

17. The vacuum chamber according to claim 1, wherein said covers are formed of steel.

18. The vacuum chamber according to claim 1, wherein said support ring is formed of copper.

19. The vacuum chamber according to claim 1, wherein said covers each have a cover section formed partially from ceramic and a cup-shaped cover part made from steel connected to said cover section.

20. The vacuum chamber according to claim 19, wherein said cover section has a first part formed in one of a frustoconical and an arcuate shape with a first diameter and an edge, and a second part being a radial section with a second diameter smaller than said first diameter and extending from said edge of said first part, said cup-shaped cover part is fastened to said radial section.

21. The vacuum chamber according to claim 20, wherein said cover section is integrally formed on said insulating cylinder.

* * * * *